US007604855B2

(12) United States Patent
Raksha et al.

(10) Patent No.: US 7,604,855 B2
(45) Date of Patent: Oct. 20, 2009

(54) KINEMATIC IMAGES FORMED BY ORIENTING ALIGNABLE FLAKES

(75) Inventors: Vladimir P. Raksha, Santa Rosa, CA (US); Paul G. Coombs, Santa Rosa, CA (US); Charles T. Markantes, Santa Rosa, CA (US); Jay M. Holman, Santa Rosa, CA (US); Neil Teitelbaum, Ottawa (CA)

(73) Assignee: JDS Uniphase Corporation, Milpitas, CA (US)

( * ) Notice: Subject to any disclaimer, the term of this patent is extended or adjusted under 35 U.S.C. 154(b) by 675 days.

(21) Appl. No.: 11/313,165

(22) Filed: Dec. 20, 2005

(65) Prior Publication Data

US 2006/0097515 A1 May 11, 2006

Related U.S. Application Data

(63) Continuation-in-part of application No. 11/022,106, filed on Dec. 22, 2004, now Pat. No. 7,517,578.

(60) Provisional application No. 60/410,546, filed on Sep. 13, 2002, provisional application No. 60/410,547, filed on Sep. 13, 2002, provisional application No. 60/396,210, filed on Jul. 15, 2002.

(51) Int. Cl.

| | |
|---|---|
| ***B41M 5/00*** | (2006.01) |
| ***B44C 1/17*** | (2006.01) |
| ***G03G 7/00*** | (2006.01) |

(52) U.S. Cl. ..... 428/195.1; 428/323; 428/402; 428/403; 428/900; 428/916; 283/72; 283/82; 283/901; 283/902; 427/152; 427/331

(58) Field of Classification Search ..... 428/195.1, 428/323, 402, 403, 900, 916; 283/72, 82, 283/901, 902; 427/152, 331

See application file for complete search history.

(56) References Cited

U.S. PATENT DOCUMENTS

| | | | | |
|---|---|---|---|---|
| 2,570,856 | A | 10/1951 | Pratt et al. | 41/32 |
| 3,123,490 | A | 3/1964 | Bolomey et al. | 106/291 |
| 3,610,721 | A | 10/1971 | Abramson et al. | 350/3.5 |
| 3,627,580 | A | 12/1971 | Krall | 117/238 |

(Continued)

FOREIGN PATENT DOCUMENTS

| | | |
|---|---|---|
| DE | 4212290 | 5/1993 |
| EP | 0341002 | 11/1989 |
| EP | 0556449 | 8/1993 |
| EP | 0406667 | 1/1995 |
| EP | 0710508 | 5/1996 |

(Continued)

OTHER PUBLICATIONS

Dobrowolski et al., "Research on Thin Film Anticounterfeiting Coatings at the National Research Council of Canada", Applied Optics, vol. 28, No. 14, pp. 2702-2717 (Jul. 15, 1989).

Powell et al, (ED.), Vapor Deposition, John Wiley & Sons, p. 132 (1996).

Van Renesse (Ed.), Optical Document Security, 2nd Ed., Artech House, 254, 349-69 (1997).

Prokes et al. (Ed.), Novel Methods of Nanoscale Wire Formation, Mat. Research Soc. Bul., pp. 13-14 (Aug. 1999).

(Continued)

*Primary Examiner*—Bruce H Hess
*Assistant Examiner*—David J Joy
(74) *Attorney, Agent, or Firm*—Matthew A. Pequignot; Pequignot + Myers LLC

(57) ABSTRACT

An image is disclosed comprised of flakes in a carrier, such as an ink vehicle or a paint that can be aligned in a magnetic field. The flakes are aligned so as to produce one or more kinematic features such as a rolling bar that appears to move as the image is tilted. These images can provide security features on high-value documents, such as bank notes.

23 Claims, 14 Drawing Sheets

U.S. PATENT DOCUMENTS

| | | | | |
|---|---|---|---|---|
| 3,633,720 | A | 1/1972 | Tyler | 400/105 |
| 3,676,273 | A | 7/1972 | Graves | 161/3 |
| 3,790,407 | A | 2/1974 | Merton et al. | 428/148 |
| 3,791,864 | A | 2/1974 | Steingroever | 117/238 |
| 3,845,499 | A | 10/1974 | Ballinger | 346/74.3 |
| 3,853,676 | A | 12/1974 | Graves | 161/5 |
| 3,873,975 | A | 3/1975 | Miklos et al. | 360/25 |
| 4,011,009 | A | 3/1977 | Lama et al. | 359/571 |
| 4,054,922 | A | 10/1977 | Fichter | 346/74.3 |
| 4,099,838 | A | 7/1978 | Cook et al. | 359/537 |
| 4,197,563 | A | 4/1980 | Michaud | 346/74.3 |
| 4,244,998 | A | 1/1981 | Smith | |
| 4,271,782 | A | 6/1981 | Bate et al. | 118/623 |
| 4,398,798 | A | 8/1983 | Krawczak et al. | 359/573 |
| 4,543,551 | A | 9/1985 | Petersen | 335/284 |
| 4,788,116 | A | 11/1988 | Hochberg | 430/21 |
| 4,867,793 | A | 9/1989 | Franz et al. | 106/415 |
| 4,931,309 | A | 6/1990 | Komatsu et al. | 427/599 |
| 5,079,058 | A | 1/1992 | Tomiyama | 428/40 |
| 5,079,085 | A | 1/1992 | Hashimoto et al. | 428/327 |
| 5,177,344 | A | 1/1993 | Pease | 235/449 |
| 5,186,787 | A | 2/1993 | Phillips et al. | 216/36 |
| 5,192,611 | A | 3/1993 | Tomiyama et al. | 428/354 |
| 5,223,360 | A | 6/1993 | Prengel et al. | 430/39 |
| 5,364,689 | A | 11/1994 | Kashiwagi et al. | 428/195 |
| 5,368,898 | A | 11/1994 | Akedo | 427/510 |
| 5,424,119 | A | 6/1995 | Phillips et al. | 428/328 |
| 5,474,814 | A | 12/1995 | Komatsu et al. | 427/549 |
| 5,613,022 | A | 3/1997 | Odhner et al. | 385/37 |
| 5,624,076 | A | 4/1997 | Miekka et al. | 241/3 |
| 5,627,663 | A | 5/1997 | Horan et al. | 359/2 |
| 5,630,877 | A | 5/1997 | Kashiwagi et al. | 118/623 |
| 5,672,410 | A | 9/1997 | Miekka et al. | 428/148 |
| 5,744,223 | A | 4/1998 | Abersfelder et al. | 428/206 |
| 5,811,775 | A | 9/1998 | Lee | 235/457 |
| 5,991,078 | A | 11/1999 | Yoshitake et al. | 359/567 |
| 6,033,782 | A | 3/2000 | Hubbard et al. | 428/407 |
| 6,043,936 | A | 3/2000 | Large | 359/572 |
| 6,068,691 | A | 5/2000 | Miekka et al. | 106/403 |
| 6,103,361 | A | 8/2000 | Batzar et al. | 428/323 |
| 6,150,022 | A | 11/2000 | Coulter et al. | 428/403 |
| 6,168,100 | B1 | 1/2001 | Kato et al. | 241/1 |
| 6,403,169 | B1 | 6/2002 | Hardwick et al. | 427/548 |
| 6,549,131 | B1 | 4/2003 | Cote et al. | 340/572.1 |
| 6,586,098 | B1 | 7/2003 | Coulter et al. | 428/403 |
| 6,589,331 | B2 | 7/2003 | Ostertag et al. | 106/460 |
| 6,643,001 | B1 | 11/2003 | Faris | 356/37 |
| 6,649,256 | B1 | 11/2003 | Buczek et al. | 428/323 |
| 6,686,027 | B1 | 2/2004 | Caporaletti et al. | 428/195.1 |
| 6,692,031 | B2 | 2/2004 | McGrew | 283/93 |
| 6,692,830 | B2 | 2/2004 | Argoitia et al. | 428/403 |
| 6,749,777 | B2 | 6/2004 | Argoitia et al. | 252/582 |
| 6,749,936 | B2 | 6/2004 | Argoitia et al. | 428/402 |
| 6,751,022 | B2 | 6/2004 | Phillips | 359/577 |
| 6,759,097 | B2 | 7/2004 | Phillips et al. | 427/510 |
| 6,808,806 | B2 | 10/2004 | Phillips et al. | 428/403 |
| 6,815,065 | B2 | 11/2004 | Argoitia et al. | 428/403 |
| 6,818,299 | B2 | 11/2004 | Phillips et al. | 428/403 |
| 6,838,166 | B2 | 1/2005 | Phillips et al. | 428/323 |
| 6,841,238 | B2 | 1/2005 | Argoitia et al. | 428/323 |
| 6,902,807 | B1 | 6/2005 | Argoitia et al. | 428/403 |
| 6,987,590 | B2 | 1/2006 | Phillips et al. | 359/2 |
| 7,029,525 | B1 | 4/2006 | Mehta | 106/31.6 |
| 7,047,883 | B2 | 5/2006 | Raksha et al. | 101/489 |
| 2002/0182383 | A1 * | 12/2002 | Phillips et al. | 428/199 |
| 2003/0190473 | A1 | 10/2003 | Argoitia | |
| 2004/0009309 | A1 | 1/2004 | Raksha et al. | 427/598 |
| 2004/0051297 | A1 | 3/2004 | Raksha | |
| 2004/0081807 | A1 | 4/2004 | Bonkowski et al. | 428/195.1 |
| 2004/0094850 | A1 | 5/2004 | Bonkowski et al. | 264/1.34 |
| 2004/0105963 | A1 | 6/2004 | Bonkowski et al. | 428/195.1 |
| 2004/0151827 | A1 | 8/2004 | Argoitia et al. | 427/7 |
| 2005/0037192 | A1 | 2/2005 | Argoitia et al. | 428/323 |
| 2005/0106367 | A1 | 5/2005 | Raksha et al. | 428/199 |
| 2005/0123755 | A1 | 6/2005 | Argoitia et al. | 428/402 |
| 2006/0035080 | A1 | 2/2006 | Argoitia et al. | 428/402 |
| 2006/0077496 | A1 | 4/2006 | Argoitia | 359/2 |
| 2006/0194040 | A1 | 8/2006 | Raksha et al. | 428/323 |
| 2006/0263539 | A1 | 11/2006 | Argoitia | 427/547 |
| 2007/0058227 | A1 | 3/2007 | Raksha et al. | 359/2 |

FOREIGN PATENT DOCUMENTS

| | | |
|---|---|---|
| EP | 0953937 | 11/1999 |
| EP | 0978373 | 2/2000 |
| EP | 1239307 | 9/2002 |
| EP | 1353197 | 10/2003 |
| EP | 1 498 545 A | 1/2005 |
| EP | 1 719 636 | 11/2006 |
| GB | 1107395 | 3/1968 |
| GB | 1131038 | 10/1968 |
| JP | 63172779 | 7/1988 |
| WO | WO88/07214 | 9/1988 |
| WO | 95/13569 | 5/1995 |
| WO | 00/08596 | 2/2000 |
| WO | 01/03945 | 1/2001 |
| WO | 02/53677 | 1/2001 |
| WO | WO 01/53113 A | 7/2001 |
| WO | 02/40599 | 5/2002 |
| WO | WO02/40600 | 5/2002 |
| WO | WO02/090002 | 11/2002 |
| WO | WO 03/011980 | 2/2003 |
| WO | 03/102084 | 12/2003 |
| WO | WO 2004/007096 | 1/2004 |
| WO | 2004/024836 | 3/2004 |
| WO | 2005/017048 | 2/2005 |

OTHER PUBLICATIONS

Lotz et al., Optical Layers on Large Area Plastic Films, Precision, Applied Films (Nov. 2001).

Argoitia et al, "Pigments Exhibiting Diffractive Effects", Soc. of Vac. Coaters, 45th Annual Tech. Conf. Proceed. (2002).

Argoitia et al, "The concept of printable holograms through the alignment of diffractive pigments", SPIE Conference on Document Security, Jan. 2004.

Coombs et al, "Integration of contracting technologies into advanced optical security devices", SPIE Conference on Document Security, Jan. 2004.

R. Domnick et al, "Influence of Nanosized Metal Clusters on the Generation of Strong Colors and Controlling of their Properties through Physical Vapor Deposition (PVD)" 49th Annual Technical Conference Proceedings (2006), Society of vacuum Coasters.

Alberto Argoitia, "Pigments Exhibiting a Combination of Thin Film and Diffractive Light Interference", AIMCAL Fall Technical Conference, 16th International Vacuum Web Coating Conference, Jan. 2002, pp. 1-9.

Llewellyn, "Dovids: Functional Beauty—discussion about holography", Paper, Film, and Foil Converter, Aug. 2002.

Hardin, "Optical tricks designed to foil counterfeiters" OE Reports, No. 191, Nov. 1999.

Himpsel et al, "Nanowires by Step Decoration", Mat. Research Soc. Bul., p. 20-24 (Aug 1999).

Halliday at al, "Fundamental of Physics, Sixth Edition", p. 662, Jul. 2000.

* cited by examiner

KINEMATIC IMAGES FORMED BY ORIENTING ALIGNABLE FLAKES

CROSS-REFERENCE TO RELATED APPLICATIONS

This patent application is a continuation-in-part and claims priority from U.S. patent application Ser. No. 11/022,106, now U.S. Pat. No. 7,517,578, filed Dec. 22, 2004, which claims priority from U.S. patent application Ser. No. 10/386,894 filed Mar. 11, 2003, now issued U.S. Pat. No. 7,047,883, which claims priority from U.S. Provisional Patent Application Ser. No. 60/410,546 filed Sep. 13, 2002, by Vladimir P. Raksha; from U.S. Provisional Patent Application Ser. No. 60/410,547 filed Sep. 13, 2002 by Vladimir P. Raksha, Paul G. Coombs, Charles T. Markantes, Dishuan Chu, and Jay M. Holman; and from U.S. Provisional Patent Application Ser. No. 60/396,210 filed Jul. 15, 2002 by Vladimir P. Raksha, Paul C. Coombs, Charles T. Markantes, Dishuan Chu, and Jay M. Holman, the disclosures of which are hereby incorporated in their entirety for all purposes.

BACKGROUND OF THE INVENTION

This invention relates generally to optically variable pigments, films, inks, paints, devices, and images, and more particularly to images with aligned or oriented pigment flakes, for example, during a painting or printing process, to obtain an illusive optical effect. This invention is particularly applicable to aligning magnetically alignable pigment flakes and is also applicable to aligning non-magnetic dielectric or semiconductor flakes in an electric field.

Optically variable devices are used in a wide variety of applications, both decorative and utilitarian. Optically variable devices can be made in variety of ways to achieve a variety of effects. Examples of optically variable devices include the holograms imprinted on credit cards and authentic software documentation, color-shifting images printed on banknotes, and enhancing the surface appearance of items such as motorcycle helmets and wheel covers.

Optically variable devices can be made as film or foil that is pressed, stamped, glued, or otherwise attached to an object, and can also be made using optically variable pigments. One type of optically variable pigment is commonly called a color-shifting pigment because the apparent color of images appropriately printed with such pigments changes as the angle of view and/or illumination is tilted. A common example is the "20" printed with color-shifting pigment in the lower right-hand corner of a U.S. twenty-dollar bill, which serves as an anti-counterfeiting device.

Some anti-counterfeiting devices are covert, while others are intended to be noticed. This invention relates to overt features, intended to be noticed, however flakes having covert features therein, such as indicia can be used. Furthermore flakes with gratings and holographic features can be used. Unfortunately, some optically variable devices that are intended to be noticed are not widely known because the optically variable aspect of the device is not sufficiently dramatic. For example, the color shift of an image printed with color-shifting pigment might not be noticed under uniform fluorescent ceiling lights, but more noticeable in direct sunlight or under single-point illumination. This can make it easier for a counterfeiter to pass counterfeit notes without the optically variable feature because the recipient might not be aware of the optically variable feature, or because the counterfeit note might look substantially similar to the authentic note under certain conditions.

Optically variable devices can also be made with magnetic pigments that are aligned with a magnetic field after applying the pigment (typically in a carrier such as an ink vehicle or a paint vehicle) to a surface. However, painting with magnetic pigments has been used mostly for decorative purposes. For example, use of magnetic pigments has been described to produce painted cover wheels having a decorative feature that appears as a three-dimensional shape. A pattern was formed on the painted product by applying a magnetic field to the product while the paint medium still was in a liquid state. The paint medium had dispersed magnetic non-spherical particles that aligned along the magnetic field lines. The field had two regions. The first region contained lines of a magnetic force that were oriented parallel to the surface and arranged in a shape of a desired pattern. The second region contained lines that were non-parallel to the surface of the painted product and arranged around the pattern. To form the pattern, permanent magnets or electromagnets with the shape corresponding to the shape of desired pattern were located underneath the painted product to orient in the magnetic field non-spherical magnetic particles dispersed in the paint while the paint was still wet. When the paint dried, the pattern was visible on the surface of the painted product as the light rays incident on the paint layer were influenced differently by the oriented magnetic particles.

Similarly, a process for producing of a pattern of flaked magnetic particles in fluoropolymer matrix has been described. After coating a product with a composition in liquid form, a magnet with desirable shape was placed on the underside of the substrate. Magnetic flakes dispersed in a liquid organic medium orient themselves parallel to the magnetic field lines, tilting from the original planar orientation. This tilt varied from perpendicular to the surface of a substrate to the original orientation, which included flakes essentially parallel to the surface of the product. The planar oriented flakes reflected incident light back to the viewer, while the reoriented flakes did not, providing the appearance of a three dimensional pattern in the coating.

It is desirable to create more noticeable optically variable security features on financial documents and other products and to provide features that are difficult for counterfeiters to copy.

It is also desirable to create features which add to the realism of printed images made with inks and paints having alignable flakes therein, especially printed images of objects and more particularly recognizable three dimensional objects.

Heretofore, in patent application PCT/US2003/020665 the inventor of the present application has described embodiments of an invention known as the "rolling-bar" and the "flip-flop" which provide kinematical features, that is features which provide the optical illusion of movement, to images comprised of magnetically alignable pigment flakes wherein the flakes are aligned in a particular manner. Although this is heralded as a significant advance in the field of alignment of pigment flakes, and more generally related to anti-counterfeiting coatings, the inventors have discovered new and exciting applications of the rolling-bar and other rolling objects such as a rolling hemisphere which yields realistic 3-D like images formed of alignable pigment flakes, not realized before. The rolling hemisphere appears to move all directions on an x-y plane in dependence upon an angle at which the image is tilted or the angle at which the light source upon the image varied.

Although the rolling bar described in the aforementioned PCT patent application provides the illusion of a moving bar across a rectangular image, this invention has limitations. It is a single kinematic feature which can be observed. It is also somewhat difficult to copy. But essentially it provides the observer with the experience of seeing a rolling bar of uniform size and intensity which is unvarying as it appears to move along the substrate upon the rectangular image it is apart of.

In this invention, the inventors have since discovered that providing a rolling bar used as a fill within an outline of a curved recognizable object, particularly a smooth curved recognizable object such as a bell, a shield, container, or a soccer ball provides striking effects that reach beyond a rolling bar moving back and forth on a rectangular sheet. The bar while providing realistic dynamic shading to an image of an object not only appears to move across the image but also appears to grow and shrink or expand and contract with this movement within the closed region in which it is contained. In some instances where the size or area of the bar doesn't vary, for example wherein it is used a as a partial fill within an image between two conforming curved lines that move together with a space between, filled by the bar, the bar appears to move across the image while simultaneously moving up and down. Thus, this invention provides a highly desired optical effect by using the rolling bar inside a non rectangular outlined closed shape of an object, wherein the area of the rolling bar changes as the bar moves across the image, and, or wherein the bar appears to move horizontally and vertically simultaneously as the image is tilted or the light source upon the image is varied. Additionally, if the bar is designed to be of a suitable size and radius of curvature, it can be used as a dynamic, moving, shrinking or expanding shading element in the image, providing exceptional realism. It has also been found, that the rolling bar appears to have a most profound effect when it appears to mimic moving shading on an image of a real object that is capable or producing a shadow when light is incident upon it. In these important applications, it is preferred that the radius of curvature of the flakes forming the rolling bar be within a range of values wherein the image of the real-object it is applied to, appears to be correctly curved so as to appear realistic. It is an object of this invention, to provide an optically illusive image having kinematical features that depend upon tilting the image or varying the location of the light source upon the image.

The term rectangular used in this specification is defined to mean a quadrilateral with four right angles. Thus a non-rectangular object or image does not have 4 sides and four right angles.

This invention refers to forming images of objects wherein the images of the object include special effects such as rolling bar effects that provide the illusion of moving shadows as the image of object is tilted or the light source upon the image is varied. The definition of object in this context is a tangible and visible entity; an entity that can cast a shadow.

The term rolling bar shall not be limited to a straight bar as it may be a curved bar, depending upon the shape of the applied field.

SUMMARY OF THE INVENTION

In accordance with an embodiment of the invention a kinematical image particularly useful as a security feature or a decorative feature is provided comprising a non rectangular closed region of an object having a rolling bar therewithin, wherein the rolling bar appears to move across the image as the image is tilted or the position of the light source upon the image is varied, and wherein the area of the rolling bar changes as the bar moves across the image, or wherein the bar appears to move horizontally and vertically simultaneously as the rolling bar appears to move.

In accordance with an embodiment of this invention a kinematical image of a three-dimensional object capable of casting a shadow, is provided particularly useful as a security feature or a decorative feature comprising a plurality of pigment flakes filling a region wherein the flakes are aligned so as to form a rolling bar, and wherein the rolling bar provides shading and depth to the image of the three dimensional object, wherein the shading appears to move as light source upon the image is varied.

In accordance with the invention, a perspective image is provided, wherein at least one region of the perspective image has flakes formed into a rolling bar, for providing shading on the perspective image.

In accordance with the invention a kinematical image is provided, comprising an image printed on a substrate, comprised of plurality of pigment flakes, wherein the flakes are in an first arching pattern to form a first contrasting bar across at least a portion of the image, and wherein the flakes are in a second arching pattern to form a second contrasting bar across at least a different portion of the image, and wherein the first and second contrasting bars appear to move in different directions simultaneously, as the image is tilted relative to a viewing angle.

In accordance with the invention, a kinematical image of an object is provided. The image comprises a plurality of field aligned pigment flakes, wherein the object has an recognizable three dimensional varying shape in three dimensional space and wherein the a rolling bar is disposed within an outline of representation of the object, so as to provide a varying shading effect as the image is tilted relative to viewing angle, and wherein the area of the rolling bar varies as the image tilted relative to viewing angle.

In accordance with the invention, an image is provided, wherein a first rolling bar comprising aligned pigment flakes occupies a first region of the image, wherein the first region has non-rectangular curved region defining a contour thereof, and wherein a second rolling bar is disposed in a second region of the image, and wherein the two rolling bars provide the viewer with an illusion of relative movement between the first and second regions as the image is tilted in one direction.

In accordance with the invention, there is provided, an image printed on a substrate comprising: a non-rectangular closed region coated with aligned pigment flakes, wherein said flakes are aligned so as to produce a kinematic object such as a bar or a hemisphere therewithin, wherein the kinematic object appears to move across the closed region as the image is tilted or the position of the light source upon the image is varied, and wherein the area of the kinematic object changes as the object appears to move across the region, or wherein the object appears to move horizontally and vertically simultaneously as the kinematic object appears to move.

In accordance with the invention, an image is provided having two rolling bars within the image, and wherein the rolling bars appear to move in different directions as the image is titled in one direction.

In accordance with the invention, an image is provided having two rolling bars within the image, and wherein the rolling bars appear to move toward or away from each other as the image is titled in one direction.

In particular embodiments of the invention, the radius of curvature of the rolling bar is at least one quarter and preferably larger than one half the radius of curvature of one of the curves within the outline of the image.

In other embodiments of the invention, the radius of curvature of the rolling bar is at least as large as the radius of curvature of one of the curves within the outline of the image.

In another embodiment the radius of curvature is sufficient to span the entire image of the three dimensional real object.

In accordance with yet another embodiment of the invention there is provided an image printed on a substrate comprising: A first region coated with aligned pigment flakes, wherein said flakes are aligned so as to produce a first kinematic object therewithin, and a second region coated with aligned pigment flakes, wherein said flakes are aligned so as to produce a second kinematic object therewithin, wherein the first and second kinematic objects appear to move in different directions simultaneously as image is tilted.

In an alternative embodiment of the invention, an image is formed having a first region coated with pigment flakes, wherein the flakes are aligned so as to form an observable moving hemisphere, providing the appearance of a rolling ball, as the image is tilted or the light source is varied.

In an embodiment of this invention an image is formed comprising the steps of providing a dome-shaped or inverted dome-shaped magnetic field;

providing a substrate with a coating of magnetically alignable pigment flakes;

disposing the coating within the dome-shaped or inverted dome-shaped magnetic field;

relatively rotating the substrate and the dome-shaped or inverted dome-shaped magnetic field; and allowing the coating to cure.

The image in accordance with this invention is difficult to counterfeit, visually appealing, easily identifiable and is particularly useful as a security feature or a decorative feature.

BRIEF DESCRIPTION OF THE DRAWINGS

Exemplary embodiments of the invention will now be described in accordance with the figures. Since the figures shown in this application represent the images in accordance with this invention, made with magnetic flakes, these effects cannot be provided in this document which attempts to describe and illustrate these kinematical and 3-D features.

DETAILED DESCRIPTION OF THE INVENTION

I. Introduction

Figure 1A:
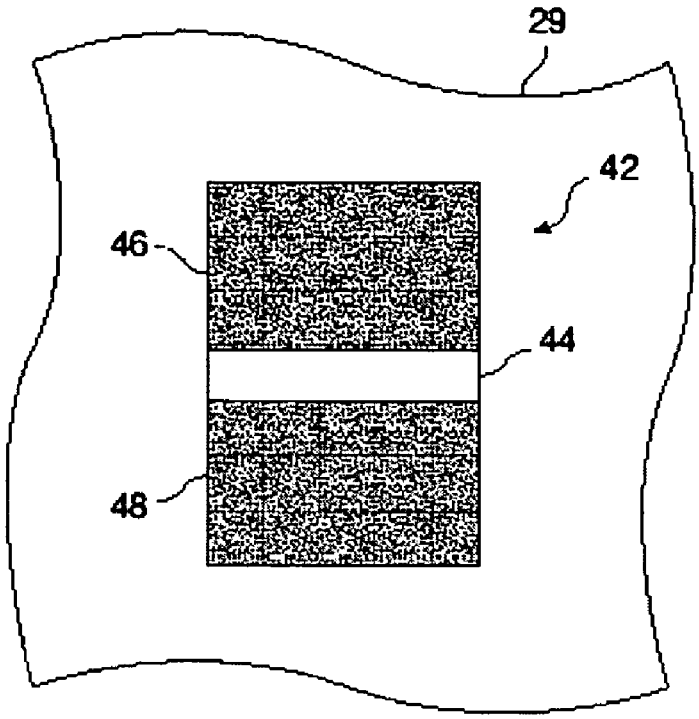
FIG. 1A is a simplified plan view of the rolling bar image at a first selected viewing angle.
Figure 1B:
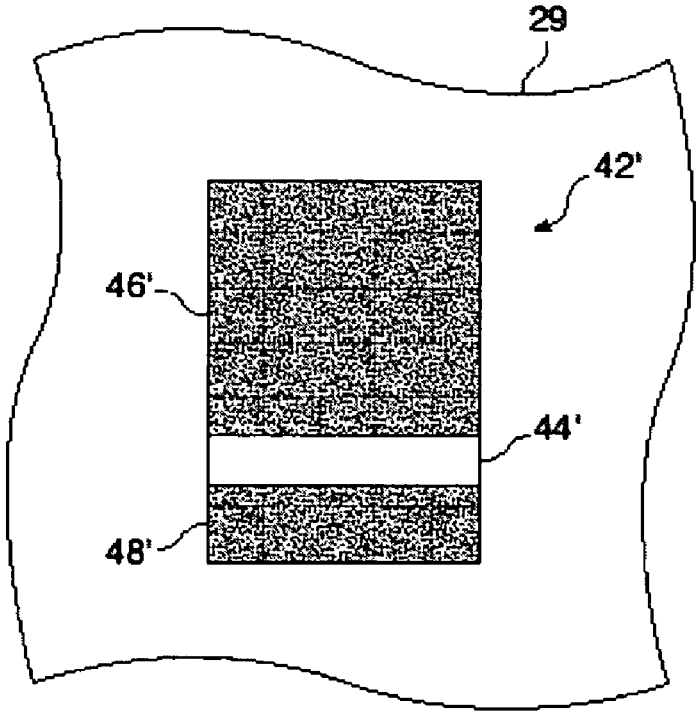
FIG. 1B is a simplified plan view of the rolling bar image at a second selected viewing angle.

The present invention in its various embodiments provides methods of orientation of magnetic flakes of optically variable ink or paint suitable in some embodiments as a high-speed printing process wherein other embodiments are more suited to a manual alignment and printing process. In addition, some embodiments of this invention require a multi-step printing process wherein a first region of a substrate is inked with magnetic flakes and exposed to a magnetic field, and wherein after curing, the same substrate is inked in a same or different region and exposed to a second magnetic field. Normally, particles of an optically variable pigment dispersed in a liquid paint or ink vehicle generally orient themselves parallel to the surface when printed or painted on to a surface. Orientation parallel to the surface provides high reflectance of incident light from the coated surface. Magnetic flakes can be tilted while in the liquid medium by applying a magnetic field. The flakes generally align in such way that the longest diagonal of a flake follows a magnetic field line. Depending on the position and strength of the magnet, the magnetic field lines can penetrate the substrate at different angles, tilting magnetic flakes to these angles. A tilted flake reflects incident light differently than a flake parallel to the surface of the printed substrate. Reflectance is and a hue can both be different. Tilted flakes typically look darker and have a different color than flakes parallel to the surface at a normal viewing angle.

Orienting magnetic flakes in printed images poses several problems. Many modern printing processes are high-speed relative to the batch-type process that apply a magnet against a static (non-moving) coated article and hold the magnet in position while the paint or ink dries. In some printing presses, the paper substrate is moving at speeds of 100-160 meters per minute. Sheets of paper are stacked after one printing operation, and fed to another. The inks used in such operations typically dry within milliseconds. Convention processes are not suitable for such applications.

It was discovered that one way to obtain enhanced optical effects in the painted/printed image, is by orienting magnetic flakes perpendicular to the direction of the moving substrate. In other words, the painted or printed liquid paint or ink medium with dispersed flakes on the substrate moves perpendicular to magnetic lines of the field to cause re-orientation of the flakes. This type of orientation can provide remarkable illusive optical effects in the printed image.

One type of optical effect will be referred to as a kinematic optical effect for purposes of discussion. An illusive kinematic optical effect generally provides an illusion of motion in the printed image as the image is tilted relative to the viewing angle, assuming a stationary illumination source. Another illusive optical effect provides virtual depth to a printed, two-dimensional image. Some images may provide both motion and virtual depth. And some images may provide the illusion or perception of motion in any direction in an x-y plane. Another type of illusive optical effect switched the appearance of a printed field, such as by alternating between bright and dark colors as the image is tilted back and forth. Another type of optical effect is created by creating an image wherein a feature of the image appears to change size as the image provides an illusion of motion. Providing a change in size of an object such as a rolling bar as the bar appears to move, provides a form of realistic animation.

II. Examples of Printed Illusive Images

Figure 2A:
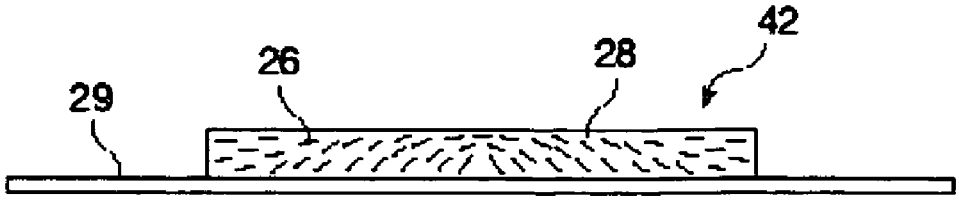
FIG. 2A is a simplified cross section of a printed image that will be referred to as a "rolling bar" for purposes of discussion, according to another embodiment of the present invention.

FIG. 1A is a simplified cross sectional view shown in published U.S. patent application 20040051297 published Mar. 18, 2004 of a printed image 29 that will be referred to as a "rolling-bar", for purposes of discussion. The image formed of pigment flakes surrounded by a carrier, such as an ink vehicle or a paint vehicle has been aligned in a particular manner of provide the rolling-bar effect. The flakes are shown in FIG. 2A as short lines in the cross-sectional view. The flakes are magnetic flakes, i.e. pigment flakes that can be aligned using a magnetic field. They might or might not retain remnant magnetization. The figures are not drawn to scale. A typical flake might be twenty microns across and about one micron thick, hence the figures are merely illustrative. The image is printed or painted on a substrate 29, such as paper, plastic film, laminate, card stock, or other surface. For convenience of discussion, the term "printed" will be used to generally describe the application of pigments in a carrier to a surface, which may include other techniques, including techniques others might refer to as "painting".

Generally, flakes viewed normal to the plane of the flake appear bright, while flakes viewed along the edge of the plane appear dark.

The carrier is typically transparent, either clear or tinted, and the flakes are typically fairly reflective. For example, the carrier could be tinted green and the flakes could include a metallic layer, such as a thin film of aluminum, gold, nickel, platinum, or metal alloy, or be a metal flake, such as a nickel or alloy flake. The light reflected off a metal layer through the green-tinted carrier might appear bright green, while another portion with flakes viewed on end might appear dark green or other color. If the flakes are merely metallic flakes in a clear carrier, then one portion of the image might appear bright metallic, while another appears dark. Alternatively, the metallic flakes might be coated with a tinted layer, or the flakes might include an optical interference structure, such as an absorber-spacer-reflector Fabry-Perot type structure. Furthermore, a diffractive structure may be formed on the reflective surface for providing an enhancement and an additional security feature. The diffractive structure may have a simple linear grating formed in the reflective surface, or may have a more complex predetermined pattern that can only be discerned when magnified but having an overall effect when viewing. By providing diffractive reflective layer, a colour change or brightness change is seen by a viewer by simply turning the sheet, banknote, or structure having the diffractive flakes.

The process of fabricating diffractive flakes is described in detail in U.S. Pat. No. 6,692,830. U.S. patent application 20030190473, describes fabricating chromatic diffractive flakes. Producing a magnetic diffractive flake is similar to producing a diffractive flake, however one of the layers is required to be magnetic. In fact, the magnetic layer can be disguised by way of being sandwiched between Al layers; in this manner the magnetic layer and then it doesn't substantially affect the optical design of the flake; or could simultaneously play an optically active role as absorber, dielectric or reflector in a thin film interference optical design.

FIG. 2A is a simplified cross section as shown in published U.S. patent application 20040051297 published Mar. 18, 2004, of a printed image 42 of a kinematic optical "rolling bar". The image includes pigment flakes 26 surrounded by a transparent carrier 28 printed on a substrate 29. The pigment flakes are aligned in a curving fashion. As with the flip-flop, the region(s) of the rolling bar that reflect light off the faces of the pigment flakes to the viewer appear lighter than areas that do not directly reflect the light to the viewer. This image provides a light band(s) or bar(s) that appear to move ("roll") across the image when the image is tilted with respect to the viewing angle (assuming a fixed illumination source(s)).

FIG. 2B is a simplified plan view of the rolling bar image 42 at a first selected viewing angle. A bright bar 44 appears in a first position in the image between two contrasting fields 46, 48. FIG. 2C is a simplified plan view of the rolling bar image at a second selected viewing angle. The bright bar 44, appears to have "moved" to a second position in the image, and the sizes of the contrasting fields 46', 48' have changed. The alignment of the pigment flakes creates the illusion of a bar "rolling" down the image as the image is tilted (at a fixed viewing angle and fixed illumination). Tilting the image in the other direction makes the bar appear to roll in the opposite direction (up).

The bar may also appear to have depth, even though it is printed in a plane. The virtual depth can appear to be much greater than the physical thickness of the printed image. The tilting of the flakes in a selected pattern reflects light to provide the illusion of depth or "3D", as it is commonly referred to. A three-dimensional effect can be obtained by placing a shaped magnet behind the paper or other substrate with magnetic pigment flakes printed on the substrate in a fluid carrier. The flakes align along magnetic field lines and create the 3D image after setting (e.g. drying or curing) the carrier. The image often appears to move as it is tilted, hence kinematic 3D images may be formed.

Although the single rectangular rolling bar as disclosed in U.S. patent application 20040051297 is an interesting eye catching effect, the provision of a moving rectangle upon a larger rectangular background appears to be somewhat limited in its application.

Figure 3A:
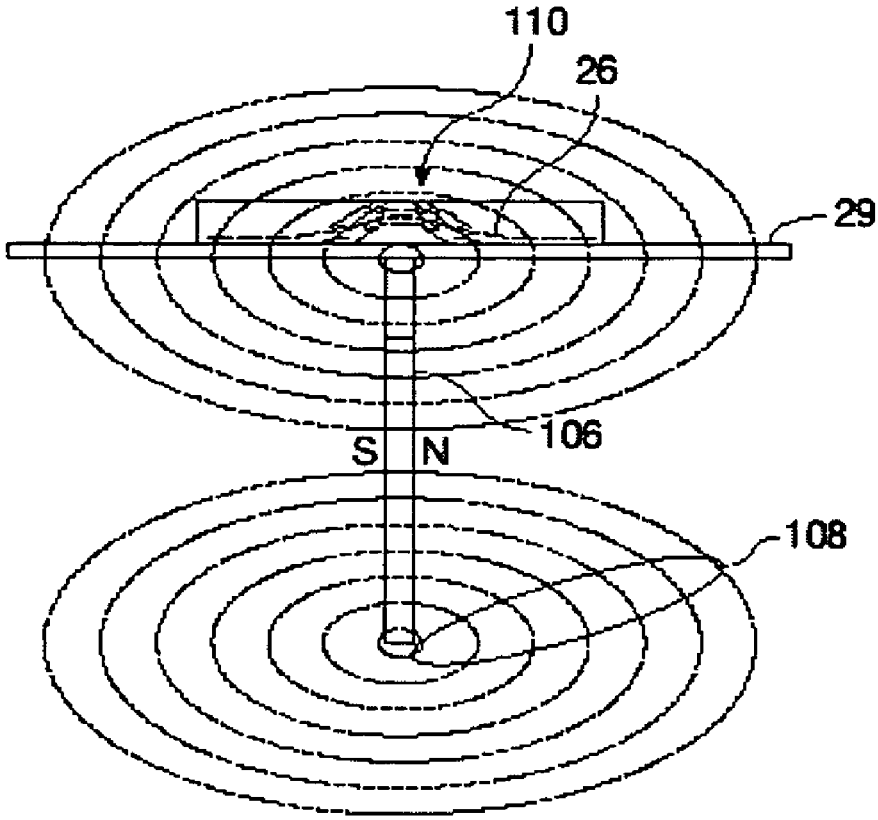
FIG. 3A is a simplified cross section of another embodiment of the invention for forming a semi-circular orientation of flakes in paint or ink for a rolling bar type image.

FIG. 3A is a simplified cross section for forming a semi-circular orientation of flakes in paint or ink for a rolling bar type image. A thin permanent magnet 106 is magnetized through its thin section, as illustrated. The magnet has circular magnetic lines 108 on its ends. The substrate 29 with the printed magnetic flakes dispersed in a fluid carrier moves along the magnet from the viewer into the paper. The flakes 26 tilt along direction of the magnetic lines 108 and form a semi-circle pattern above the magnet.

Figure 3B:
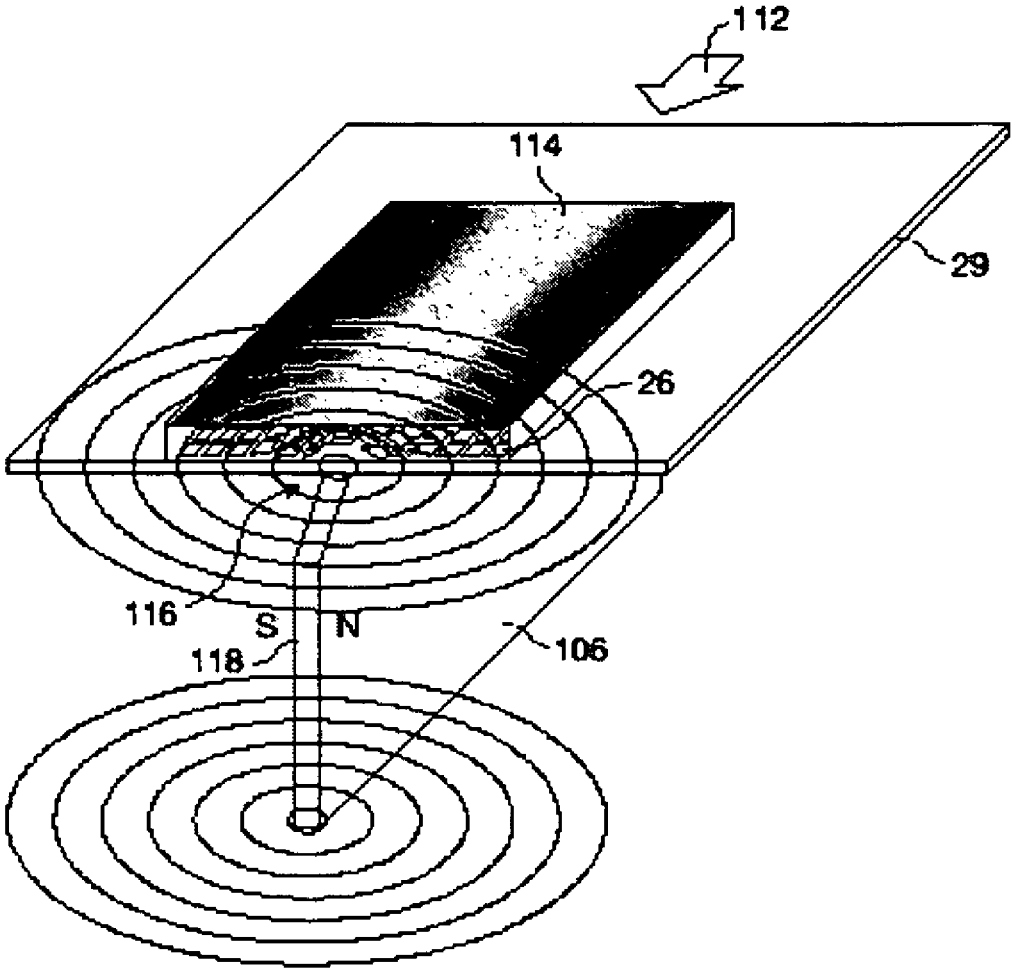
FIG. 3B is a simplified perspective view of apparatus in accordance with FIG. 3A.

FIG. 3B is a simplified perspective view of an apparatus in accordance with FIG. 3A. The substrate 29 moves across the magnet 106 in the direction of the arrow. The image 110 forms a rolling bar feature 114, which will appear to move up and down as the image is titled or the viewing angle is changed. The flakes 26 are shown as being tilted in relation to the magnetic field lines. The image is typically very thin, and the flakes might not form a hump, as illustrated, but generally align along the magnetic field lines to provide the desired arched reflective properties to create a rolling bar effect. The bar appeared to roll up and down the image when tilted through an angle of about 25 degrees in one example.

It was found that the intensity of the rolling bar effect could be enhanced by chamfering 116 the trailing edge 118 of the magnet. It is believed that this gradually reduces the magnetic field as the image clears the magnet. Otherwise, the magnetic transition occurring at a sharp corner of the magnet might re-arrange the orientation of the flakes and degrade the visual effect of the rolling bar. In a particular embodiment, the corner of the magnet was chamfered at an angle of thirty degrees from the plane of the substrate. An alternative approach is to fix the flakes before they pass over the trailing edge of the magnet. This could be done by providing a UV source part way down the run of the magnet, for UV-curing carrier, or a drying source for evaporative carriers, for example.

Figure 4A:
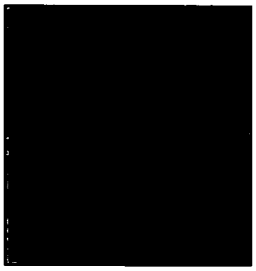
FIG. 4A is a plan view of an image comprised of non-aligned magnetic pigment flakes cured on a substrate.
Figure 4B:
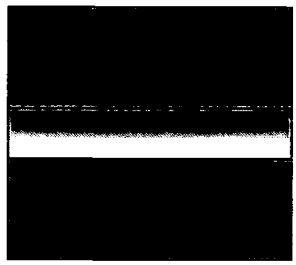
FIG. 4B is a plan view of the flakes and substrate shown in FIG. 4A after the flakes have been aligned and permanently fixed by curing the pigment so as to orient them into a rolling bar similar to FIGS. 1A and 1B.
Figure 5A:
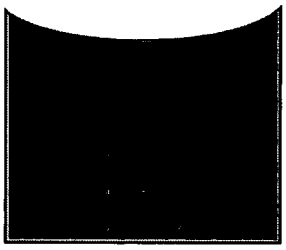
FIG. 5A is a plan view of an image having a curved upper contour comprised of non-aligned magnetic pigment flakes.
Figure 5B:
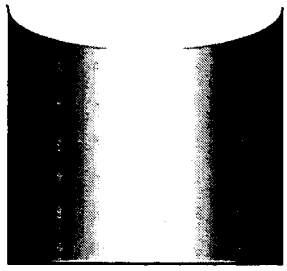
FIG. 5B is a plan view of the image similar to FIG. 5A with the flakes aligned into a large rolling bar, with a substantially large radius of curvature.
Figure 6:
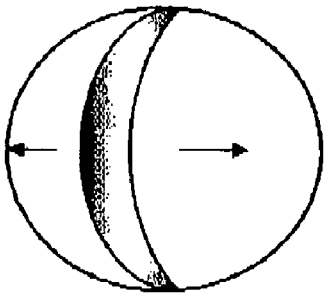
FIG. 6 is a partial perspective view of an image of a sphere wherein an outline of a circle has a rolling bar spanning its diameter providing the illusion of a sphere.
Figure 7:
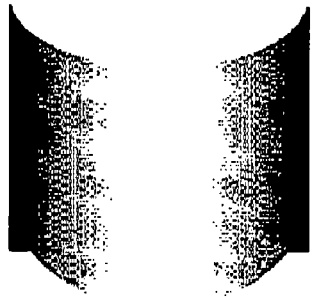
FIG. 7 is a shape similar to FIG. 5B wherein both upper and lower surfaces are curved.

Referring now to FIG. 5A, an image in the form of a 4 sided outline or closed region is shown wherein the top side is curved downward. It is interesting to note that upon looking at this figure, there is no particular association with an image made and it is not recognizable as a common object; it is merely a 2-D polygon. On the other hand, upon viewing, FIG. 5B having the same outline and the same flakes but oriented differently an association with a known common recognizable object, a cylinder is made. By providing a large rolling bar that spans the region the rolling bar adds shading so that the user perceives depth and three-dimensionality. In addition to this by tilting the image in FIG. 5B, comprised of magnetically oriented pigment flakes, the rolling bar appears to move across the image and its area changes as it sweeps the cylinder. FIG. 4B doesn't conjure the same association; and as the bar appears to move in FIG. 4B, it's dimensions do not change. This change in area of the rolling bar, experienced when viewing FIG. 5B significantly adds to making the object appear more real, as the bar shrinks and then appears to expand in height. It fills a smaller region and subsequently fills a larger region as it appears to move from the centre towards the sides. Furthermore, if one compares FIGS. 5A and 5B, the rolling bar within the curved upper region of FIG. 5B seems to force the viewer to at least partially experience the presence of a white lid or interior of the cylinder. This does not occur when viewing FIG. 4A, 4B, or 5A. Thus there are several advantages to filling a curved polygon with a rolling bar. FIGS. 6 and 7 show rolling bars in two other shapes wherein the rolling bar provides a perception of depth, movement, and wherein the actual area of the bar varies as it sweeps the image.

Figure 12:
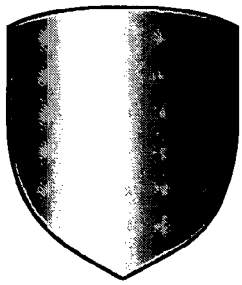
FIG. 12 is an image of a shield wherein the rolling bar provides a kinematic effect and wherein the bar provides shading and depth adding realism to the image not attainable in a photograph or painting.
Figure 13:
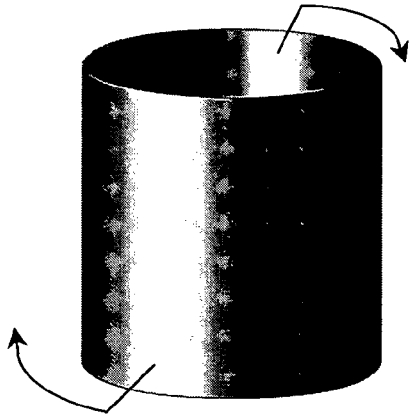
FIG. 13 is an image of a hollow cylinder or pipe with a double (concave and convex) rolling bar, wherein the concave rolling bar is shown on the inside wall, and wherein the two rolling bars move oppositely as shadows and light in the real object would move.
Figure 14A:
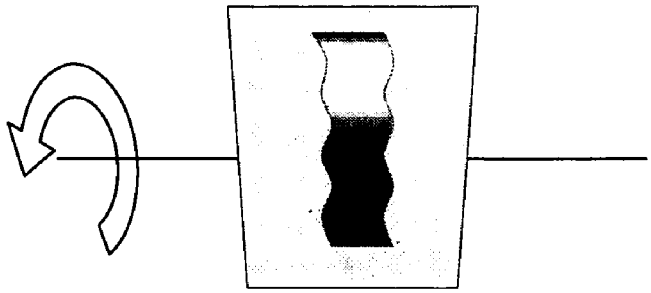
FIGS. 14A through 14D are views of a curved image having a rolling bar shown at four different viewing angles.
Figure 14B:
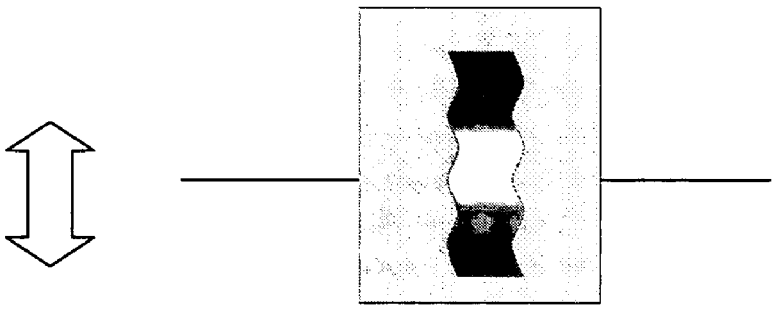
Figure 14C:
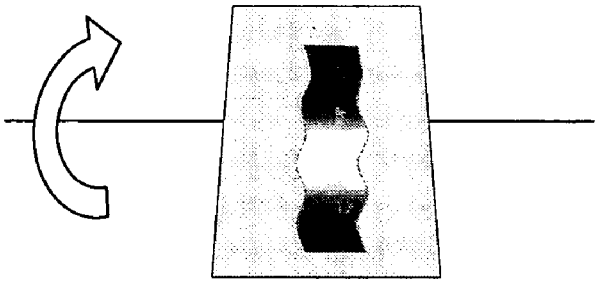
Figure 14D:
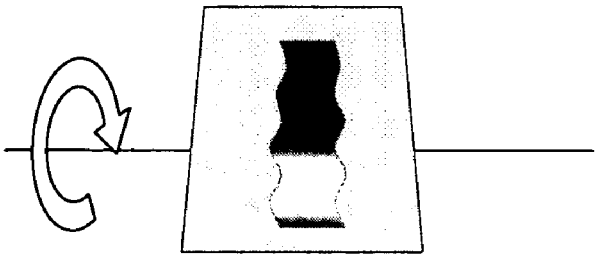

Referring now to FIG. 12, a shield is shown, comprising an outline having magnetically oriented pigment flakes disposed therein, oriented in the form of a rolling bar having a large radius of curvature. It is important to select a radius of curvature that will provide an expected sense of depth and curvature to most closely represent the image that is created. In all of the curved images described heretofore, the presence of a rolling bar provides a perceived change in area of the rolling bar as the image is tilted and the bar appears to move across the image. This phenomenon is quite striking and is illustrated by the sequence of FIGS. 14A through 14D. These figures are of the same image tilted at different angles, with an increasing angle in each subsequent figure with FIG. 14A being at normal incidence. In comparison with the simpler rolling bar of FIG. 4B, wherein the bar simply appears to move from one location to the next, there is no reference to there being a change in the appearance of the bar itself at different locations. The bar in FIG. 4*b* in one location or another as it appears to move, presents the same way. However, the bar in FIGS. 14A and 14*b* has a completely different shape; and, as the image is tilted the shape of the rolling bar continuously changes, by definition and synergy of what appears to be movement of the bar, combined with morphing of the bar combined with the bar rising and falling adds greatly to the attractiveness of the image. An image with these features can be used as a security feature on an article, as decoration, or as a means of providing the illusion of complex motion for use in the visual arts.

Although the changing shape of the rolling bar shown in FIGS. 5B, 6, 7, 10, 12 and 13 is less pronounced, it is still present and provides the illusion of the bar moving laterally and upward or downward, since the bar follows a smooth curve.

Referring now to FIG. 6, a circle is shown having a rolling bar spanning its diameter. The circle in the absence of the rolling bar is merely what the viewer perceives as a circle, however the presence of the rolling bar provides the viewer with the illusion that the object is a sphere. Although movement is not shown in the figure, the viewer witnessing the bar rolling along the circle apparently becoming smaller as the image is tilted and the bar moves toward the left, give the viewer a sense of three dimensionality and realism. As opposed to looking at a painting where light and shadows and highlights are fixed, this kinematical image provides the viewer with the experience of the light and shadows moving across the ball as the image is tilted. The view has the perception of moving around the object or the viewed object being rotated. Furthermore, since the area of the bar decreases as it moves to the left the viewer has the perception that this object is more than just a picture or photograph. It is for all intents and purposes a flat image however the viewer perceives depth and movement and an enhanced viewing experience in contrast to viewing a "normal" image. It has three dimensionality, movement and change of shape that occurs when viewing and tilting the object.

In FIG. 7 the area of the rolling bar shown by highlights in the centre fading off to dark regions toward the sides, as it appears to sweep across the image has a substantially uniform area, however, the bar appears to follow the curved trajectory of the upper and lower walls as it fills the outline and appears to project out of the page, moving from a lower central position to an upper right most or left most position as it rises. Here the viewer experiences sideways and upward motion of the bar, as well as a 3-D effect.

Figure 8A:
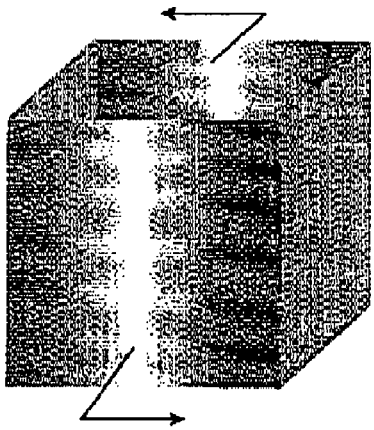
FIG. 8A is an image in perspective view of container, having a rolling bar applied to an outer front wall, and another rolling bar on the inner back wall, wherein the two rolling bars move in opposite directions simultaneously as the image is tilted in the direction of one of the arrows.
Figure 9:
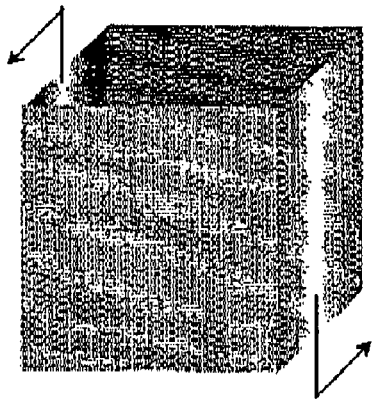
FIG. 9 is a perspective view of an image of a container similar to the one shown in FIG. 8A wherein rolling bars are shown on adjacent outside inside faces, wherein the rolling bars move oppositely and wherein the rolling bar on the inner face changes area and shape as it is perceived to move upon tilting.

Referring now to FIG. 8A an alternative embodiment of the invention is shown wherein two rolling bars are designed to move oppositely simultaneously when the image is tiled in one direction; for example toward the right pointing arrow, about a longitudinal axis of one of the rolling bars.

Figure 8B:
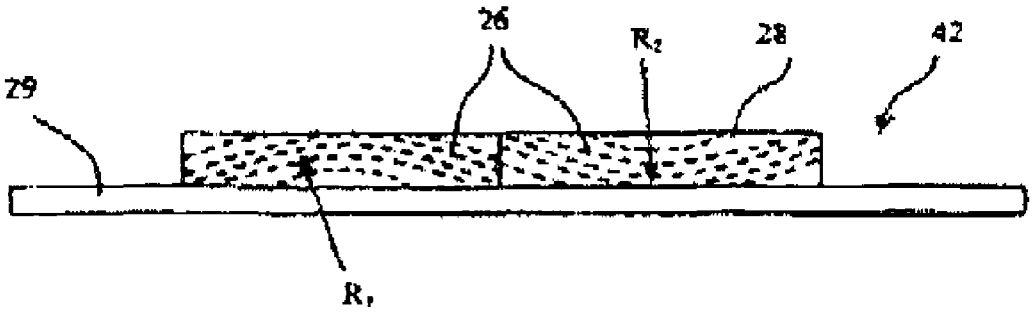
FIG. 8B, shown on a separate sheet from FIG. 8A, is a cross-sectional view of two rolling bars shown in FIG. 8C.
Figure 8C:
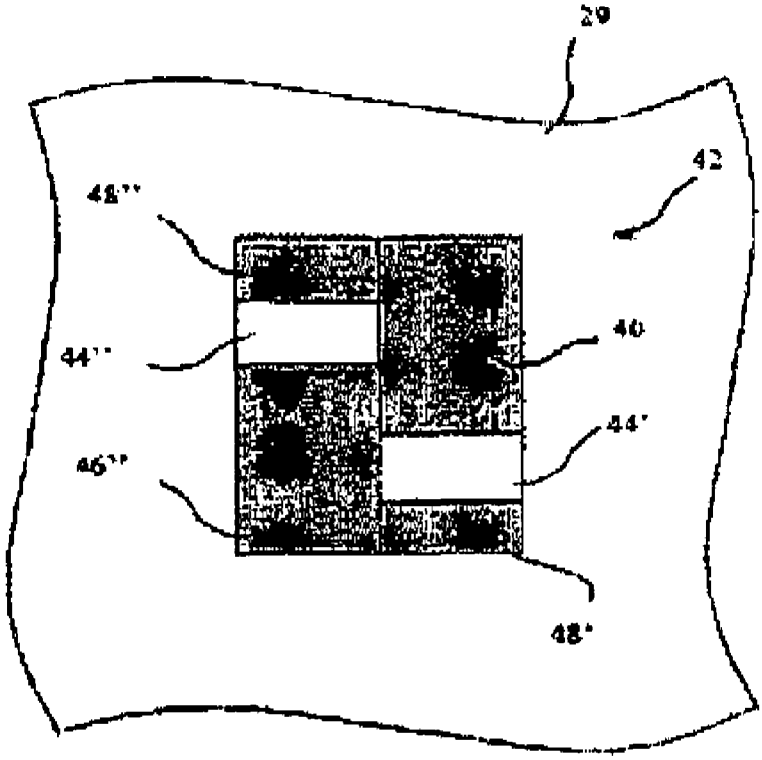
FIG. 8C is a plan view of a more simple arrangement of two rolling bars which move oppositely, simultaneously, as the image is tilted.
Figure 10:
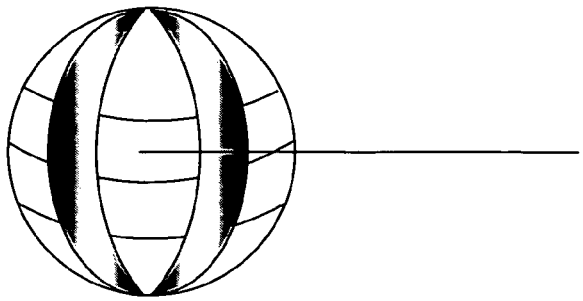
FIG. 10 is an image of a sphere having two rolling elongate shapes shown which provide a 3-D realistic quality to the image as the image it tilted.
Figure 11:
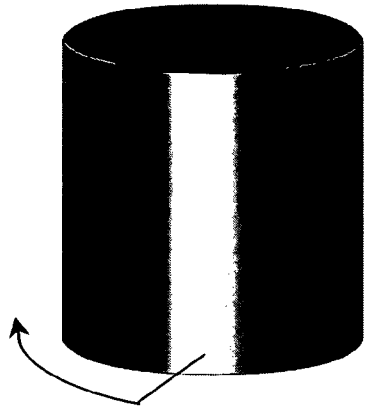
FIG. 11 is an image of a cylinder having rolling bar on an outer front-facing surface of the cylinder.

In an embodiment of the present invention, shown in FIGS. 8B and 8C an image with a "double rolling bar" is shown, wherein one portion 44' has magnetic flakes oriented in convex fashion while another portion 44" of the image has magnetic flakes oriented in a concave orientation. To achieve this convex orientation, the "rolling bar" magnet is placed underneath the paper substrate. For the concave orientation, the magnet is placed above the paper substrate. A "Double tilt" image is formed when magnetic flakes in two regions of the image have differing and opposing orientation, for example, +30 degrees and −30 degrees. At one tilted position of the printed image one part of the image is dark and another part is light. When printed image is tilted in an opposing direction, the areas switch their light and dark regions so that the first image becomes light and the second image becomes dark. Depending upon the intended design, this switch of the light and dark may occur from the top to the bottom and back, as well as from the left to the right and back, in dependence upon the on orientation of the flakes. In FIGS. 8C and 8D the bright bar 44' appears to have "moved" to a second position in the image, and the sizes of the contrasting fields 46', 48' have changed; furthermore the bright bar 44" appears to have "moved" to a different position in the image, and the sizes of the contrasting fields 46", 48" have changed.

Figure 15A:
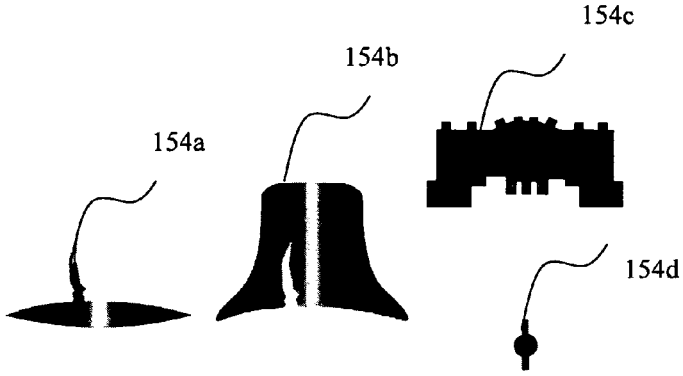
FIG. 15A is illustrates four components of the liberty bell printed on a rectangular substrate. Inner part of the bell is printed with the concave rolling bar and the outer part of the bell is printed with the convex rolling bar.
Figure 15B:
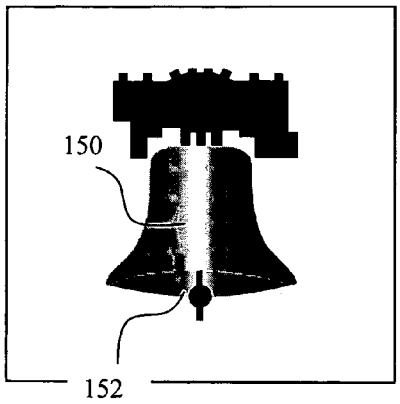
FIG. 15B is a drawing of an image of the liberty bell at normal angle.
Figure 15C:
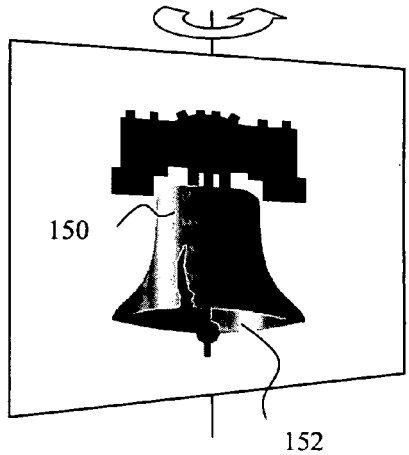
FIG. 15C shows the bell when the substrate is tilted to the right
Figure 15D:
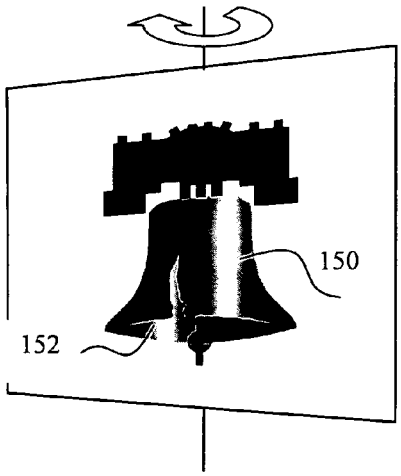
FIG. 15D shows the bell when the substrate is tilted to the left.

An embodiment of the invention in accordance with FIGS. 15A through 15D will now be described. In FIGS. 15B through 15D, the "liberty bell" is shown. In FIG. 15A the image is shown at a normal angle of incidence. In FIGS. 15B through 15D, the same print is shown tiled at different angles of incidence as indicated by arrows about the axis. As can be observed, the rolling bar 150 shown if FIG. 15B, having a large radius of curvature appears to shift to the left when viewing FIG. 15C, and the smaller concave inverted rolling bar 152 on the inside surface of the bell, appears to move oppositely, to the left. FIG. 15D illustrates an opposite perceived movement, wherein the larger bar 150 when tilted oppositely shows the large bar 150 appearing to shift to the right while the smaller bar 152 simultaneously appears to roll to the left. This behavior of the light incident upon the image, mimics a real lighting situation on a real object such as the liberty bell. The lighting shifts simultaneously and oppositely in different regions as one would expect from a real object. Thus the illusion is designed to follow the physics of natural light on the real object. The illusion is that the image is real. Turning now to FIG. 15A, the four elements 154*a*, 154*b*, 154*c*, and 154*d*, that comprise the bell are shown separately, for ease of understanding, and each of these is printed, one at a time, in the correct location upon the substrate to form the image shown in FIG. 15A. Although the image is formed by printing each region and applying the magnets to form flakes aligned in oppositely arching patterns to create the two rolling bars, a sequenced automated printed process could be used to produce this and similar images.

Figure 16A:
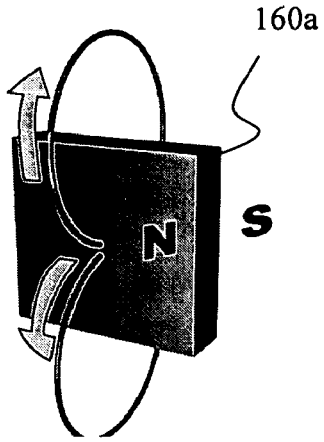
FIG. 16A is a perspective view of a magnet which makes up a magnetic configuration shown in FIG. 16C for providing a dome shaped magnetic field as shown in FIG. 16C.
Figure 16B:
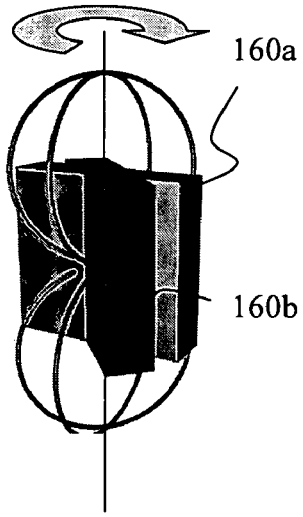
FIG. 16B is a perspective view having some magnets cutaway for ease of viewing for providing a dome-shaped field.
Figure 16C:
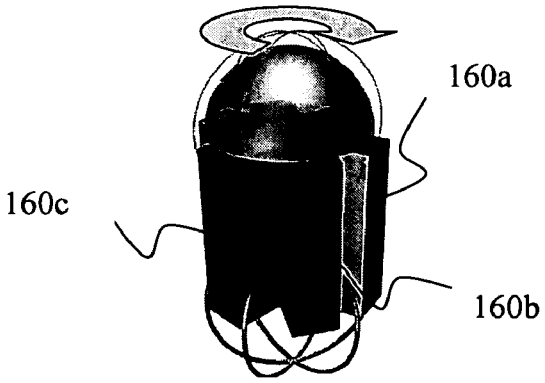
FIG. 16C is a perspective view of a magnetic arrangement for providing dome-shaped magnetic field.
Figure 16D:
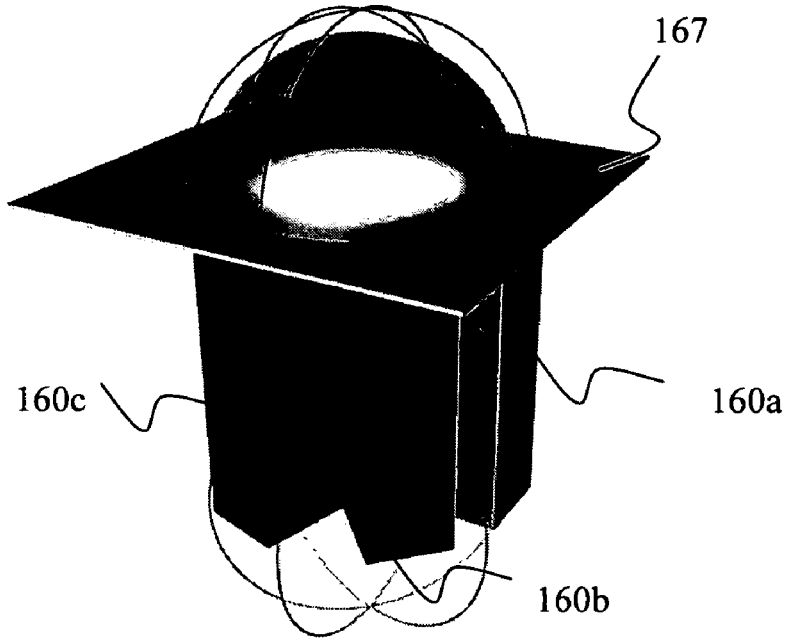
FIG. 16D is a perspective view of the magnetic arrangement of FIG. 16C wherein sheet having flaked ink applied thereto is disposed in the dome-shaped field and wherein the sheet and field are relatively rotated indicated by the arrows in the subsequent two figures.
Figure 16E:
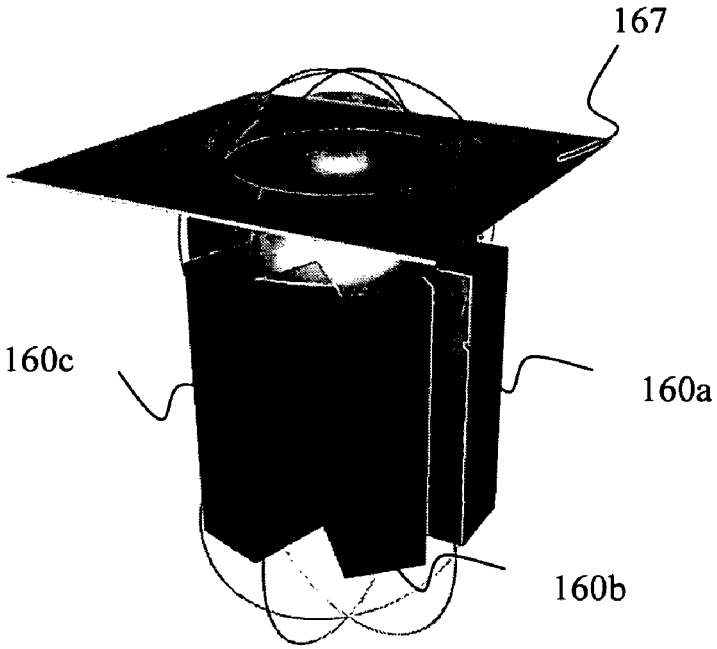
FIG. 16E is a perspective view similar to that of FIG. 16D, wherein the sheet is disposed closer to the top of the dome-shaped field and wherein a hemispherical image formed in the ink would be smaller in size than in FIG. 16D.
Figure 16F:
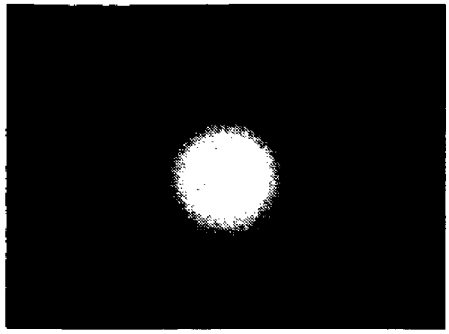
FIGS. 16F and 16G are images of the rolling 3-D hemisphere made using the magnets of FIG. 16E shown at different positions as the image is tilted from one position to another.
Figure 16G:
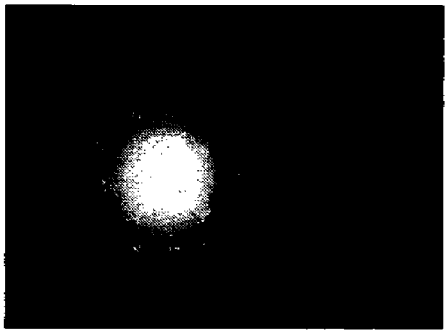
Figure 16H:
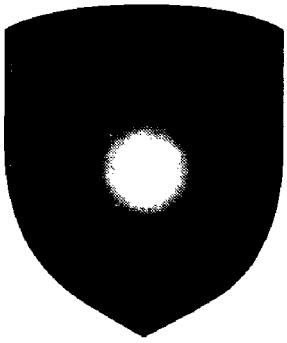
FIG. 16H is a printed image of a hemisphere having dome shaped flakes disposed in an image of a shield.

An interesting and striking effect is shown in an alternative embodiment of this invention in FIGS. 16F, 16G, 16H and 16J. FIG. 16F is a printed image of a hemisphere wherein the entire image is coated with alignable pigment flakes. After alignment of flakes as will be explained, the hemisphere is formed. The printed image of the hemisphere shown in FIG. 16F appears as the image shown in FIG. 16G as the substrate is tilted or the light source varied. As the image is tilted from the normal to the left about a vertical axis through the centre, the bright hemisphere which appears much like a ball, rolls with a change of tilt angle. In contrast to the rolling bar, which was capable of rolling in a plane along a line, the hemisphere in FIG. 16F is capable or appearing to move in any x-y direction, depending upon the angle of tilt. Thus, tilting the image about the x or y axis results in the appearance of movement.

Figure 16I:
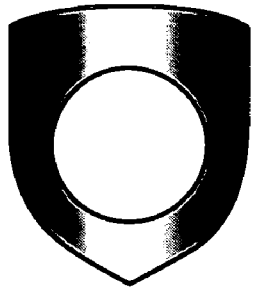
FIG. 16I is a printed image of a shield having a rolling bar formed along an axis thereof.
Figure 16J:
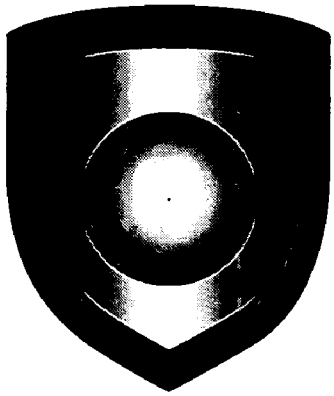
FIG. 16J is a composite image of the images formed in FIGS. 16H and 16I, wherein the ink and magnetic fields are applied in stages so that FIG. 16I is applied over FIG. 16H and wherein the centre region is coated only once, when forming the rolling hemisphere.

The shield in FIG. 16J uses a combination of a rolling bar and hemisphere effects to provide very interesting combination of effects wherein the shield and hemisphere appear to project out of the page. This is produced in a two stage process, wherein the substrate is first coated with a magnetic coating and a hemisphere is formed and cured as in FIG. 16H. A second coating is applied through a mask or stencil to form the coating of FIG. 16I ensuring that no additional coating material covers the hemisphere. This second coating is placed in a magnetic field so as to produce a rolling bar. The method of forming the dynamic or kinematic hemispherical image described above is more complex than the method of forming the rolling bar. With reference to FIGS. 16A through 16E, the method will now be described. By way of example, the magnet 160*a* shown in FIG. 16A illustrates a field line above and below the magnet, forming two loops. This diagram purposely only shows these two lines, however, there is essentially a front of lines that would be generated parallel to these lines, spanning the entire magnet. The magnets 160*a*, 160*b* used to create the hemisphere are more complex as is shown in FIG. 16B and more particularly in 16C. Part of the magnet in FIG. 16B is cut away to illustrate some of the field lines. In FIG. 16C it is clear that the field extending above the cluster of magnets 160*a*, 160*b*, 160*c* is dome shaped, as is the magnetic field extending below. A print of a hemispherical kinematic image is formed as in FIG. 16D or 16E by disposing the coated substrate 167 with fluid ink in the dome shaped magnetic field, just above the magnets as shown in FIG. 16D or with greater separation from the magnets and supported toward the middle of the field while the magnets are spinning. In this exemplary embodiment the velocity at which the magnets or image are relatively rotated is approximately 120 rpm. The image is then removed from the region of the field and is cured. The rotation velocity of the magnets can be slower or faster than 120 rpm, depending on the particles magnetic properties and viscosity of the ink vehicle. If the velocity is too slow however, the quality of the image will degrade.

Figure 17A:
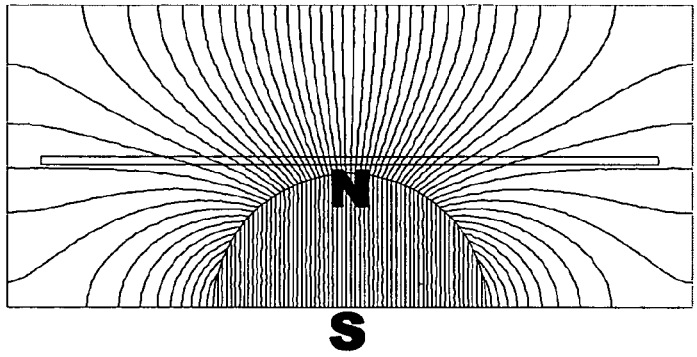
FIG. 17A is a cross-section of a bowl shaped field used to form the image of FIG. 17C.
Figure 17B:
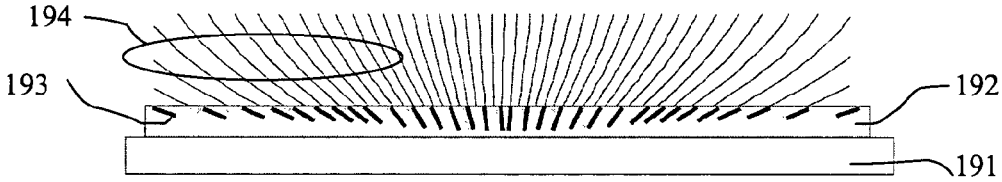
FIG. 17B is cross-sectional of pigment flakes in a carrier aligned in the magnetic field shown in FIG. 17A.
Figure 17C:
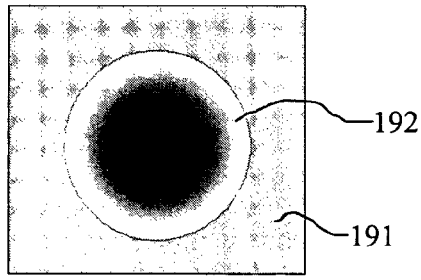
FIG. 17C is an image formed with magnetic flakes in the field shown in FIG. 17A of an inverted hemisphere which appears to be a rolling bowl sunken into the page.

FIG. 17A is an illustration of an alternative embodiment similar but inverted to the image shown in FIG. 16F. A simulated magnetic field from a hemispherical magnet is shown in FIG. 17A. This is the shape of the field that created the image shown in FIG. 17C. The North pole of the magnet is on the top and the particles are aligned concentrically in a funnel-like fashion. The field 194 in FIG. 17B is shown and flakes 193 in a carrier 192 disposed upon substrate 191 are aligned in a funnel like orientation following the field lines. Opposite to the hemispherical effect, this field generated a bright kinematic spot 192 in the middle of the image 191; and the funnel-like alignment of flakes generated a dark kinematic spot in the middle of the image. Although the fields shown and described are formed from permanent magnets, electric fields or electro-magnetic fields can be used in many embodiments. Of course, the field and the particles must be compatible so that the particles are capable of being oriented by the particular field.

While the invention has been described above in reference to particular embodiments and the best mode of practicing the invention, various modifications and substitutions may become apparent to those of skill in the art without departing from the scope and spirit of the invention. Therefore, it is understood that the foregoing descriptions are merely exemplary, and that the invention is set forth in the following claims.

What is claimed is:

1. An article for producing a first rolling bar, comprising a substrate having a first region coated with aligned pigment flakes, wherein said flakes are aligned so as to form a first arching pattern in a cross-section of the first rolling bar, and so that the first rolling bar appears to roll across the first region as the article is tilted or the position of the light source upon the article is varied, and wherein the first region is a non-rectangular region so that, when the first rolling bar rolls across the first region, it appears to change its length, or to move in the direction of its length, or to change its area.

2. An article as defined in claim 1, wherein the first rolling bar appears lighter than surrounding flakes as it appears to roll.

3. An article as defined in claim 1, wherein the first rolling bar appears darker than surrounding flakes as it appears to roll.

4. An article as defined in claim 1, wherein the first rolling bar is a curved rolling bar.

5. An article as defined in claim 1, including a second region coated with a second plurality of pigment flakes aligned in a second arching pattern so as to produce a second rolling bar.

6. An article as defined in claim 5, wherein the first and second arching patterns are oppositely arching and the first and second rolling bars appear to roll in different directions as the article is tilted or when viewed from a different direction.

7. An article as defined in claim 6, wherein the article comprises an image of a container having an outer front wall and a partially visible inner back wall; wherein the first rolling bar appears to roll within the outer front wall and the second rolling bar appears to roll within the partially visible inner back wall, whereby the image appears to be a three-dimensional image moving as the article is tilted and appears to provide a perception of depth and movement which increases recognition of the object.

8. An article as defined in claim 1, further comprising a second region coated with a second plurality of pigment flakes aligned in a dome pattern so as to produce a rolling hemisphere which appears to move when the article is tilted.

9. An article as defined in claim 1, wherein the first region has one or more curved lines and the first rolling bar follows the one or more curved lines as it appears to roll.

10. An article as defined in claim 1, wherein the first region is at least a part of an image of a three-dimensional object, wherein the rolling bar provides shading and depth to the image of the three dimensional object, wherein the shading appears to move as light source upon the image is varied.

11. An article comprising an image printed on a substrate comprising:

a non-rectangular closed region coated with aligned pigment flakes, wherein said flakes are aligned in an arching pattern so as to produce a kinematic object therewithin, wherein the kinematic object appears to move across the closed region as the image is tilted or the position of the light source upon the image is varied, and wherein the area of the kinematic object changes in size as the object appears to move across the region, or wherein the object appears to move horizontally and vertically simultaneously as the kinematic object appears to move.

12. An article comprising an image printed on a substrate, the image comprising: a plurality of magnetic pigment flakes in a carrier wherein a portion of the plurality of magnetic flakes are aligned in an arching pattern relative to a surface of the substrate so as to create a contrasting bar across the image appearing between a first adjacent field and a second adjacent field, the contrasting bar appearing to move relative to the first adjacent field and the second adjacent field as the image is tilted.

13. An article comprising printed a substrate comprising:

a first region coated with a first plurality of aligned pigment flakes, wherein said flakes are aligned in a first pattern arching in a first direction so as to produce a first kinematic object therewithin, and a second region coated with a second plurality of aligned pigment flakes, wherein said flakes are aligned in a second pattern arching in a second direction opposite to the first direction so as to produce a second kinematic object therewithin;

wherein the first and second kinematic objects appear to move in different directions simultaneously as the article is tilted.

14. An article as defined in claim 13, wherein the first and second kinematic objects are rolling bars, and wherein the rolling bars move in opposite directions as the article is titled.

15. An article as defined in claim 14, wherein the article comprises an image of a container having an outer front wall and a partially visible inner back wall; wherein a first of the rolling bars appears to move within the outer front wall and a second of the rolling bars appears to move within the partially visible inner back wall, whereby the image appears to be a three-dimensional image moving as the substrate is tilted.

16. An article as defined in claim 15, wherein the image is an image of a box, a cylinder or a bell.

17. An article as defined in claim 14, wherein the rolling bars are parallel to one another.

18. The article as defined in claim 14, wherein at least one of the rolling bars appears to change its length, or to move in the direction of its length, or to change its area.

19. A perspective image of an object as defined in claim 13, wherein the first kinematic object is a rolling hemisphere, and the second kinematic object is a rolling bar.

20. An article as defined in claim 13, wherein the first kinematic object is a curved rolling bar.

21. An article as defined in claim 13, wherein the first kinematic object is a straight rolling bar.

22. An article as defined in claim 13, wherein the first and second arching patterns are patterns of a hemisphere and an inverted hemisphere.

23. A method of forming an image, comprising the steps of:

coating a substrate with coating of pigment flakes, and before the coating cures, exposing the coating to varying magnetic field, by moving the substrate within a magnetic field, or by varying a magnetic field permeating the coating.

* * * * *